United States Patent [19]

Goossens et al.

[11] Patent Number: 4,668,417

[45] Date of Patent: May 26, 1987

[54] ELECTROVISCOUS FLUIDS

[75] Inventors: John Goossens, Cologne; Günter Oppermann, Leverkusen; Wolfgang Podszun, Cologne; Volker Härtel, Germering, all of Fed. Rep. of Germany

[73] Assignees: Bayer Aktiengesellschaft, Leverkusen; Metzeler Kautschuk GmbH, Munich, both of Fed. Rep. of Germany

[21] Appl. No.: 855,873

[22] Filed: Apr. 24, 1986

[30] Foreign Application Priority Data

May 14, 1985 [DE] Fed. Rep. of Germany ..... 3517281

[51] Int. Cl.[4] ..... C10M 125/26; C10M 149/10

[52] U.S. Cl. ..... 252/75; 252/74; 252/77

[58] Field of Search ..... 252/75, 74, 77

[56] References Cited

U.S. PATENT DOCUMENTS

| | | | |
|---|---|---|---|
| 3,047,507 | 7/1962 | Winslow | 252/74 |
| 3,397,147 | 8/1968 | Martinek | 252/75 |
| 3,970,573 | 7/1976 | Westhaver | 252/74 |

FOREIGN PATENT DOCUMENTS 1076754 7/1967 United Kingdom .

OTHER PUBLICATIONS

Shulman et al., "Rheological Transformers", Elektroreol.: Issled. Prilozh., 1981, 3-26, (CA 98:109679c).

*Primary Examiner*—Robert A. Wax

*Attorney, Agent, or Firm*—Sprung, Horn, Kramer & Woods

[57] ABSTRACT

An electroviscous fluid comprising more than 25% by weight of silica gel with a water content of 1 to 15% by weight, a non-conductive oily phase dispersion medium, 1 to 30% by weight of one or more polymers soluble in the dispersion medium, the weight percentage being based on the water-containing silica gel, and the polymers having a molecular weight in the range of from $5\times10^3$ to $10^6$ and containing 0.1 to 10% by weight of N and/or OH and 25 to 83% by weight of $C_4$ to $C_{24}$-alkyl groups. Such electroviscous fluids are useful for transmitting powerful forces by means of a low electronic output, for example, in hydraulic valves and shock absorbers.

20 Claims, 1 Drawing Figure

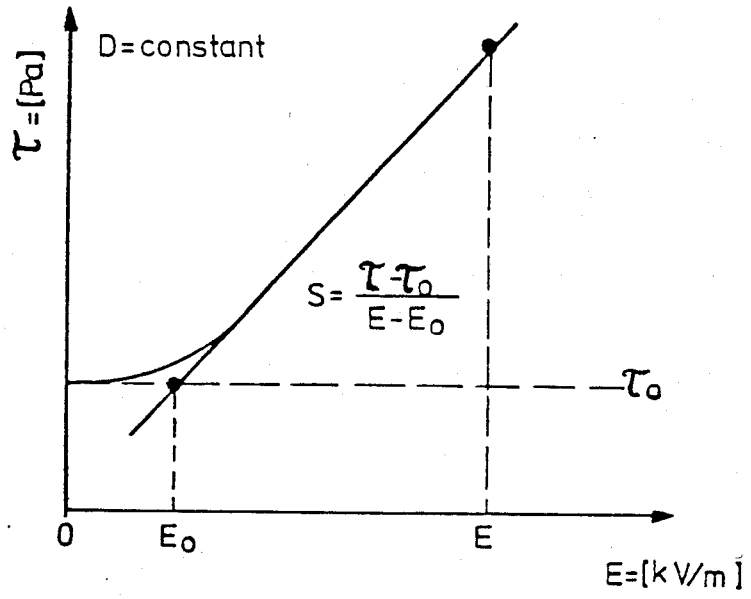
D=constant
τ=[Pa]
S= (τ-τ0)/(E-E0)
τ0
0
E0
E
E=[kV/m]

ELECTROVISCOUS FLUIDS

BACKGROUND OF THE INVENTION

This invention is based on electroviscous suspensions containing more than 25% by weight of silica gel with a water content of 1 to 15% by weight as disperse phase and liquid hydrocarbons as liquid phase and a dispersing agent.

Electroviscous fluids (EVF) are dispersions of finely divided hydrophilic solids in hydrophobic, electrically non-conductive oils whose viscosity can be increased very rapidly and reversibly under the influence of a sufficiently powerful electric field from the liquid to the plastic or the solid state. Both continuous and alternating electric fields may be used for altering the viscosity. The currents flowing through the EVF are extremely low. EVFs may therefore be used wherever powerful forces are required to be transmitted by means of a low electric output, e.g., in clutches, hydraulic valves, shock absorbers, vibrators or apparatus for positioning and fixing workpieces.

The general requirements in practice are that the EVF should be liquid over a temperature range from about −50° C. to 150° C. and chemically resistant and should show a sufficient electric viscous effect, at least in the temperature range of −30° C. to 110° C. It is also important that the EVF remain stable over a long period of time, i.e., no phase separation should take place and in particular there should be no formation of a sediment which is difficult to redisperse.

EVFs based on silica gel dispersions in non-conductive oils have been fully described in British Pat. No. 1 076 754. In these dispersions, water-containing silica gel particles are dispersed in a non-conductive oil. The water content of the silica gel particles and the form in which this water is bound should be critical with respect to the electroactivity of the EVF. Non-ionic surface active agents and/or surface active agents containing a basic nitrogen atom are used for dispersing the particles. These EVFs, however, have a strong tendency to settle and to form a sediment which is difficult to redisperse, and the examples given in the abovementioned Patent also relate to highly thixotropic fluids and pastes. Both these properties, however, restrict the possible applications of electroviscous fluids. This applies particularly to the use of a thixotropic EVF as coupling fluid or the use of a paste as hydraulic fluid.

It is at this point that the invention sets in.

SUMMARY OF THE INVENTION

It is an object of the present invention to provide electroviscous fluids which at room temperature are liquid dispersions with little or no thixotropic character and which undergo little or no phase separation when left to stand or at least are readily redispersible if phase separation occurs. Furthermore, they should manifest strong electroviscous effects over a wide temperature range and react rapidly and reversibly to changes in the electric field.

Starting with an electroviscous suspension based on silica gel and non-conductive liquid hydrocarbons, this problem is solved according to the invention by the addition of dispersing agents consisting of polymers which are soluble in the liquid hydrocarbon phase and which contain from 0.1 to 10% by weight of N and/or OH and from 25 to 83% by weight of $C_{40}$-$C_{24}$-alkyl groups and have a molecular weight in the range of $5\times10^3$ to $10^6$. These polymeric dispersing agents are added at a concentration of 1 to 30% by weight, preferably up to 20% by weight, based on silica particles. It has surprisingly been found that significantly more pronounced electroviscous effects can be obtained by means of the abovementioned polymeric dispersing agents than with the known dispersing agents.

BRIEF DESCRIPTION OF THE DRAWING

The drawing, a plot of $\tau$=[Pa] versus E=[kV/m], shows the shear stress of an EVF according to the present invention.

DETAILED DESCRIPTION OF THE INVENTION

Particularly suitable nitrogen-containing polymers are those containing amine, amide, imide or nitrile groups or nitrogen-containing 5-membered or 6-membered heterocyclic rings.

Polymers which are built up at least in part of monomers containing the following groups are particularly suitable:

- Amine groups:
  - Aminoalkylmethacrylates and acrylates such as dimethylaminoethylmethacrylate, 3-dimethylamino-2,2-dimethyl-propylmethacrylate, N,N-dihydroxyethyl-aminoethylmethacrylate, diethylaminoethylacrylate, and N-vinyl- and N-allyl-amines such as, for example, N-vinyl aniline.
- Amide groups:
  - Acrylamide and methacrylamide including their N-alkyl derivatives, e.g., N,N-dimethylacrylamide and acrylanilide;
  - vinyl derivatives of carboxylic acid amides, such as N-vinyl acetamide.
- Imide groups:
  - Maleic imide and the N-substituted derivatives
- Nitrile groups:
  - Acrylonitrile and methacrylonitrile.
- 5-membered rings:
  - Preferably derivatives having a pyrrole, imidazole, pyrazole or oxazole ring, such as N-vinylpyrrolidone, N-vinylpyrrolidones which are alkylated in the nucleus, N-vinyl-2-methyl imidazole, 3,5-dimethyl-1-vinylpyrazole, 1-(4-vinylphenyl)-pyrazolidone-3,4,5-dimethyl-2-vinyloxazole, 2-isopropenyl-4,5-dimethyloxazole, 5-decyl-3-vinyl-oxazolinone, and
  - 4-ethyl-2-isopropenyl-4-methyl-oxazolinone-5.
- 6-membered rings:
  - Preferably pyridine compounds, e.g., 2-vinylpyridine, 4-vinylpyridine, 2-isopropenylpyridine, 5-ethyl-2-vinylpyridine and 2-dimethylamino-4-vinylpyridine.

Suitable OH-containing polymers preferably contain aliphatic primary, secondary or tertiary alcohol groups. For example, copolymers containing vinyl alcohol units obtainable by hydrolysis of the corresponding vinyl acetate copolymers may be used. Polymers containing the following monomer units are also suitable:

- Hydroxyalkylmethacrylates, hydroxyalkylacrylates, such as 2-hydroxyethylmethacrylate, 2-hydroxypropylmethacrylate and 3-hydroxy-2,2-bis-(hydroxymethyl)propylacrylate, acrylamide derivatives such as N-hydroxymethylacrylamide, and styrene derivatives such as α,α-dimethyl-4-benzyl alcohol.

In addition to the above mentioned N- and OH-structural units, the polymer contains 25 to 83% by weight, preferably 45 to 78% by weight of $C_4$–$C_{24}$-alkyl groups. These alkyl groups may be either straight chained or branched. Alkyl groups having 8 to 18 carbon atoms are particularly preferred. These alkyl groups may be constituents of the above described functional monomers, e.g., when 2-vinyl-5-stearylpyridine is used, although the alkyl groups are generally introduced into the polymer by copolymerization. Examples of suitable comonomers include stearyl methacrylate, dodecylmethacrylate, decylmethacrylate, 2-ethylhexylmethacrylate and the corresponding acrylate compounds.

The advantageous properties of the polymer are still preserved if minor quantities, for example, up to a maximum of 35% by weight, of other known vinyl and vinylidene compounds, e.g., $C_1$–$C_3$-alkylacrylate, $C_1$–$C_3$-alkylmethacrylate, vinyl acetate, vinyl propionate, styrene, α-methylstyrene, butadiene, vinyl chloride or vinylidene chloride are included in the copolymerization.

The invention provides the following advantages: The electroviscous fluids according to the invention have a high stability against settling and are only slightly thixotropic and can in any case be readily reliquefied. The electroviscous fluids according to the invention are surprisingly also found to manifest distinctly more pronounced electroviscous effects than the known EVFs. Furthermore, their reaction to the electric field applied is completely reversible, independently of the frequency, and they are effective over a wide temperature range. Another important advantage is that these EVFs are relatively easily prepared and therefore inexpensive, and ordinary commercial silica gels may be used as starting materials.

The invention is described in more detail below with the aid of examples illustrated by diagrams and a Table.

The FIGURE shows the shear stress of the EVF as a function of the electric field strength at constant shearing velocity. Tables 1 and 2 show the characteristic data of the EVF according to the invention compared with the state of the art. The process for preparing the EVFs, the chemical method of preparation of the dispersing agents, the measurement technique required for controlling the desired physical properties and typical exemplary embodiments of the EVFs according to the invention are given.

Ordinary commercial silica gels may be used for the preparation of electroviscous fluids. The moisture content of the silica gel may be raised or lowered as required. For the preparation of the dispersions, the dispersion medium and all or part of the total quantity of dispersing agent are introduced into the reaction vessel and the silica gel is introduced into the dispersion medium with continuous stirring. The silica gel may initially be added rapidly, but towards the end it is added slowly as the viscosity of the silica gel increases. If only a proportion of the dispersing agent is initially introduced, then the remainder of the dispersing agent is added together with the addition of the silica gel, but the procedure adopted is not critical for the properties of the EVF finally obtained, nor is the method of mixing critical for these properties. For example, simple stirrer apparatus, ball mills or ultrasound may be employed for dispersion, but vigorous mixing generally enables the dispersions to be prepared more rapidly and obtained in a somewhat more finely divided form. The silica gel content should be at least 25% (by weight), preferably more than 35% are most preferably more than 40%.

The quantity of dispersing agent required depends to a large extent on the specific surface area of the silica gel used. As a guideline, it may be said that about 1 to 4 $mg/m^2$ may be required. The absolute quantity required also depends on the nature of the silica gel and on the dispersing agent used.

Examples of commercial silica gels include Ultrasil®, Durosil® and Extrusil® of Degussa and Vulcasil®, Silicasil® and Bysikal® types of silica gel from Bayer AG of Leverkusen, West Germany. The silica gels used need not consist of pure $SiO_2$ and may well contain up to about 20% by weight of $Al_2O_3$, $Na_2O$ and CaO. They may also contain a few percent by weight of $SO_3$, Cl and $Fe_2O_3$. The loss by annealing, that is to say the weight loss at 1000° C., generally lies in the range of 10 to 15% by weight. Of this weight loss, about 6% by weight on average is due to loss of moisture, which is the same as the weight loss determined by drying at 105° C. The specific surface area, measured by the BET method, generally lies in the range of from 20 to 200 $m^2/g$, but is not critical and may well be somewhat lower or higher. An excessively high specific surface area, however, may necessitate the use of an excessively large quantity of dispersing agent, which in turn is liable to result in an unacceptably high basic viscosity of the dispersion, especially if the dispersing agent has a relatively high molecular weight.

The liquid hydrocarbons used as dispersion media may be paraffins, olefins or aromatic hydrocarbons. Since the electroviscous fluids should have as low a basic viscosity as possible and are required to be used at relatively high temperatures, it is preferred to use hydrocarbons boiling within the use of 150° to 220° C. Moreover, it is particularly preferred to use substances with a high flash point, such as isododecane.

The preparation of polymers used as dispersing agents is in principle known to the man of the art.

The polymers may be prepared by the known methods of ionic and preferably radical polymerization, and the reaction may be carried out as mass polymerization or solution, precipitation, suspension or emulsion polymerisation. Radical solution polymerization in apolar solvents such as toluene or isododecane is particularly advantageous. Such polymerization is initiated by means of the usual radical formers such as peroxides and azo compounds.

The electroviscous fluids prepared by these methods are investigated in a modified rotation viscosimeter of the kind described by W. M. Winslow in *J. Appl. Phys.*, 20 (1949), pages 1137 to 1140.

The electrode surface of the inner rotating cylinder having a diameter of 50 mm is about 78 $cm^2$, and the width of the gap between the electrodes is 0.58 mm. For the dynamic measurements, the shear stress may be adjusted to a maximum of 2330 $s^{-1}$. The range of measurement of the viscosimeter for shear stress is maximally 750 Pa. Both static and dynamic measurements may be carried out. Both direct currents and alternating current may be used for activating the EVF.

In some liquids, activation with direct current may result not only in a spontaneous increase in the viscosity, or the yield value when the field is switched on, but also in a slow deposition of solid particles on the electrode surface, whereby the measured results may be falsified, especially when the shear velocities are low or when static measurements are carried out. Examination of the EVF is therefore preferably carried out with alternating voltage and under a dynamic shear stress. Accurately reproducible flow graphs are then obtained.

To determine the electroreactivity, a constant shear velocity $0<D<2330\ s^{-1}$ is established and the dependence of the shear stress $\tau$ upon the electric field strength E is measured. The test apparatus can be used to produce alternating fields up to a maximum effective field strength of 2370 kV/m at a maximum effective current of 4 mA and a frequency of from 50 to 550 Hz. The measurements are preferably carried out at 50 Hz because the total current is then at its lowest and the electric power required is therefore also at its lowest. Flow graphs corresponding to those in the FIGURE are obtained. It may be seen that the shear stress $\tau$ at low field strengths initially increases in a parabolic form while at higher field strengths it increases linearly. The inclination S of the linear part of the graph is indicated in the FIGURE and given in terms of Pa.m/kV. The point of intersection of the straight line S with the straight line $\tau=\tau_0$ (shear stress without electric field) is used to determine the threshold $E_0$ of the electric field strength and is given in kV/m. The increase in shear stress $\tau(E)-\tau_0$ in the electric field $E>E_0$ conforms to the equation:

$$\tau(E)-\tau_0=S(E-E_0).$$

The measurements may be repeated at different shear velocities D. The values for $E_0$ and S then obtained are generally scattered over a range of about +5% to ±20% around the mean value.

The thixotropy and redispersibility of the samples were tested after 2 weeks and after 6 weeks by assessing the flow characteristics of the samples and the time required for shaking the samples so that they again became highly fluid. The samples could be shaken by hand, but a mechanical shaker was used if the samples were difficult to redisperse.

In the exemplary embodiments described below, Formulations Nos. 1 and 2 are state of the art and Examples Nos. 3 to 10 are electroviscous fluids according to the invention. The Examples used for comparision were based on the Formulations given in Example III of British Patent No. 1 076 754 as these showed the best results in their strength of electroviscous properties in a direct field as well as in an alternating field. The electroviscous properties are entered in Table I and the stability characteristics of the samples in Table II.

EXAMPLES OF PRACTICAL APPLICATION

Silica gel:
about 80% by weight $SiO_2$
about 6% by weight CaO
about 3% by weight $Na_2O$
<0.4% by weight $Al_2O_3$ Loss on annealing according to DIN 55921/2: about 7% by wt.

Loss on drying according to DIN 55921/2: about 6% by wt.

BET surface area: about 35 $m^2/g$
Dispersion medium: Isododecane
Viscosity at 25° C.: 1.3 (mPa.s)
Density at 20° C.: 0.75 (g/ml)
Dielectric constant at 20° C.: 2.1

Dispersing agents

The polymeric dispersing agents indicated hereinafter were prepared by the following general method:

Monomers and starter are dissolved in isododecane with exclusion of oxygen in a 2 liter round glass beaker equipped with paddle stirrer and gas inlet and gas outlet tube. Polymerization is carried out at the given temperature while the reaction mixture is gassed with nitrogen and stirred at 400 revs/min.

The polymers may be isolated by precipitation with methanol but the polymer solutions obtained are generally used directly for the preparation of EV fluids. Dispersing agents: CNH 1010 and CNH 1020 Decyl methacrylate, N,N-dimethylaminoethylmethacrylate and 1 g of azo-isobutyric acid dinitrile are dissolved in 500 g of isododecane and heated to 60° C. for 18 hours.

| | CNH 1010 | CNH 1020 |
|---|---|---|
| Decylmethacrylate | 450 g | 400 g |
| N,N—Dimethylaminoethyl-methacrylate | 50 g | 100 g |
| Solids content | 45% | 39.5% |
| N—content of the polymer | 0.9% | 1.8% |
| [η] in $CHCl_3$ at 25° C. | 0.64 [dl/g] | 0.6 [dl/g] |

Dispersing agent: CBA 1010

90 g of Decylmethacrylate, 10 g of tert.-butylacrylamide and 2 g of dibenzoylperoxide in 400 g of isododecane are reacted at 70° C. for one hour and then at 90° C. for one hour.

Dispersing agent: CVP 1010

2 g of Dibenzoyl peroxide are added to 180 g of decyl methacrylate and 20 g of vinyl pyrrolidone dissolved in 800 g of isododecane and the reaction mixture is maintained at 70° C. for 2 hours. A further 2 g of dibenzoyl peroxide is then added and the mixture is heated to 90° C. for 2 hours.

Solids content of the solution: 18.9%

N-content of the solid: 1.1%.

Dispersing agent: COH 1002

245 g of Dodecyl methacrylate, 2 g of β-hydroxyethyl methacrylate and 0.5 g of azoisobutyric acid dinitrile are dissolved in 250 g of isododecane and heated to 60° C. for 7 hours.

Solids content of the solution: 43%

[η] at 25° C. in chloroform: 1.5 [dl/g]

Dispersing agents: CCN 1005 and CCN 1010

Decyl methacrylate, acrylonitrile and 1 g of azoisobutyric acid dinitrile are dissolved in 500 g of isododecane and maintained at 60° C. for 18 hours.

| | CCN 1005 | CCN 1010 |
|---|---|---|
| Decyl methacrylate | 475 g | 450 g |
| Acrylonitrile | 25 g | 50 g |
| Solids content | 35% | 37% |
| [η] in $CHCl_3$ at 25° C. | 0.3 | 0.26 |

Dispersing agent: CCN 805

Same as CCN 1005 except that ethyl hexyl methacrylate was used instead of decyl methacrylate.

Dispersing agent: CPY 1005

475 g of Dodecyl methacrylate and 25 g of freshly distilled vinyl pyridine are dissolved in 500 g of isododecane, and 1 g of azoisobutyric acid dinitrile is added thereto. The solution is kept at 60° C. for 18 hours with stirring.

Solids content of the solution: 43%.

50 parts by weight of silica gel and 50 parts by weight of isododecane were used in all the examples.

The nature and quantity of dispersing agents will be given below. The quantity refers to the solids content of the solutions of dispersing agent.

EXAMPLE 1

1.5 Parts by weight of 2-heptadecenyl-4-ethyl-2-oxazoline-4-methanol (Alkaterge E®)

1.5 parts by weight of glycerol mono- and dioleate (Atmos 300®)

EXAMPLE 2

2.5 Parts by weight of 2-heptadecenyl-4-ethyl-2-oxazoline-4-methanol (Alkaterge E®)

2.5 parts by weight of glycerol mono- and dioleate (Atmos 300®)

EXAMPLE 3

3.75 Parts by weight of Dispersing agent CNH 1010

EXAMPLE 4

5 Parts by weight of Dispersing agent CNH 1020

EXAMPLE 5

5 parts by weight of Dispersing agent CBA 1010

EXAMPLE 6

7.5 Parts by weight of Dispersing agent COH 1002

EXAMPLE 7

2.5 Parts by weight of Dispersing agent CCN 1005

2.5 parts by weight of Dispersing agent CCN 1010

EXAMPLE 8

5 Parts by weight of Dispersing agent CCN 805

EXAMPLE 9

5 parts by weight of Dispersing agent CPY 1005

EXAMPLE 10

2.5 Parts by weight of Dispersing agent CNH 1010

2.5 parts by weight of Dispersing agent CVP 1010

TABLE I

| Example No. | Temp. (°C.) | Frequency (Hz) | $E_o$ [kV · m$^{-1}$] | S [Pa · m · kV$^{-1}$] · $10^{-3}$ |
|---|---|---|---|---|
| 1 | 25–90 | 50 | irreversible deposits* | |
| | 25 | 200 | 730 | 344 |
| | 60 | 200 | 610 | 236 |
| | 90 | 200 | 579 | 444 |
| 2 | 25 | 50 | irreversible deposits* | |

TABLE I-continued

| Example No. | Temp. (°C.) | Frequency (Hz) | $E_o$ [kV · m$^{-1}$] | S [Pa · m · kV$^{-1}$] · $10^{-3}$ |
|---|---|---|---|---|
| | 25 | 200 | 815 | 427 |
| 3 | 25 | 50 | 815 | 427 |
| 4 | 25 | 50 | 1025 | 578 |
| | 60 | 50 | 670 | 860 |
| 5 | 25 | 50 | 735 | 491 |
| 6 | 25 | 50 | 611 | 737 |
| 7 | 25 | 50 | 748 | 721 |
| 8 | 25 | 50 | 710 | 761 |
| 9 | 25 | 50 | 684 | 782 |
| 10 | −10 | 50 | 1025 | 676 |
| | 25 | 50 | 863 | 784 |
| | 60 | 50 | 582 | 952 |
| | 90 | 50 | 670 | 820 |

*A layer is deposited on the electrode and does not redisperse when the electric field is switched off.

TABLE II

| | Assessment after 2 weeks | | | Assessment after 14 weeks | | |
|---|---|---|---|---|---|---|
| | | Redispersibility | | | Redispersibility | |
| Example No. | Flow characteristics of the sample | By hand (sec.) | Mechanical shaker (min.) | Flow characteristics of the sample | By hand (sec.) | Mechanical shaker (min.) |
| 1 | solid | | 30 | solid | | 30 |
| 2 | solid | | 20 | solid | | >30 |
| 3 | solid | <10 | | solid | <10 | |
| 4 | solid | <10 | | solid | <30 | |
| 5 | viscous liquid | <10 | | viscous liquid | <10 | |
| 6 | solid | <10 | | solid | | <5 |
| 7 | viscous liquid | <20 | | solid | <60 | |
| 8 | viscous liquid | <15 | | solid | <60 | |
| 9 | viscous liquid | <20 | | solid | | <5 |
| 10 | viscous liquid | <10 | | solid | <10 | |

It will be appreciated that the instant specification and claims are set forth by way of illustration and not limitation, and that various modifications and changes may be made without departing from the spirit and scope of the present invention.

We claim:

1. An electroviscous fluid comprising more than 25% by weight of silica gel with a water content of 1 to 15% by weight, a non-conductive oily phase dispersion medium, 1 to 30% by weight of one or more polymers soluble in the dispersion medium, the weight percentage being based on the water-containing silica gel, the polymers having a molecular weight in the range of from $5\times10^3$ to $10^6$ and containing 0.1 to 10% by weight of N and/or OH-containing compounds and 25 to 83% by weight of $C_4$ to $C_{24}$-alkyl groups.

2. An electroviscous fluid according to claim 1, wherein the polymer is present in an amount of up to 20% by weight, based on the weight of the water-containing silica gel.

3. An electroviscous fluid according to claim 1, containing an N-containing compound having a moiety selected from the group consisting of an amine group, an amide group, an imide, a nitrile group, and a 5-6-membered, N-containing heterocyclic ring.

4. An electroviscous fluid according to claim 2, wherein the N-containing compound is a pyrrolidone compound corresponding to formula I

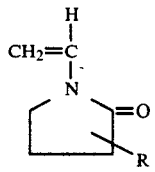

(I)

wherein

R=H or $C_1$ to $C_{24}$-alkyl.

5. An electroviscous fluid according to claim 2, wherein the amine group is selected from the group consisting of aminoalkylmethacrylates and acrylates.

6. An electroviscous fluid according to claim 2, wherein the amine group is selected from the group consisting of dimethylamino-ethylmethyacrylate, 3-dimethylamino-2,2-dimethyl-propylmethacrylate, N,N-dihydroxyethyl-aminoethylmethacrylate, diethylaminoethylacrylate, N-vinyl-amines and N-alkyl-amines.

7. An electroviscous fluid according to claim 2, wherein the amide group is selected from the group consisting of acrylamides, methacrylamides, N-alkyl derivatives of acrylamides and N-alkyl derivatives of methacrylamides.

8. An electroviscous fluid according to claim 2, wherein the amide group is selected from the group consisting of N,N-dimethylacrylamide, acrylanilide and vinyl derivatives of carboxylic acid amides.

9. An electroviscous fluid according to claim 2, wherein the imide group is selected from the group consisting of maleic imide and N-substituted derivatives of maleic imide.

10. An electroviscous fluid according to claim 2, wherein the nitrile group is selected from the group consisting of acrylonitrile and methacrylonitrile.

11. An electroviscous fluid according to claim 2, wherein the N-containing heterocyclic ring is selected from the group consisting of pyrrole compounds, imidazole compounds, pyrazole compounds, oxazole compounds and pyridine compounds.

12. An electroviscous fluid according to claim 2, wherein the N-containing heterocyclic ring is selected from the group consisting of N-vinylpyrrolidone; N-vinylpyrrolidones which are alkylated in the nucleus; N-vinyl-2-methyl-imidazole; 3,5-dimethyl-1-vinyl-pyrazole; 1-(4-vinylphenyl)-pyrazolidone-3; 4,5-dimethyl-2-vinyloxazole; 2-isopropenyl-4,5-dimethyloxazole; 5-decyl-3-vinyl-oxazolinone; 4-ethyl-2-isopropenyl-4-methyl-oxazolinone-5; 2-vinylpyridine; 4-vinylpyridine; 2-isopropenylpyridine; 5-ethyl-2-vinylpyridine and 2-dimethylamino-4-vinylpyridine.

13. An electroviscous fluid according to claim 1, wherein the polymer contains an OH-containing compound which is an alcohol.

14. An electroviscous fluid according to claim 13, wherein the alcohol is an alcohol which contains aliphatic primary, secondary or tertiary alcohol groups.

15. An electroviscous fluid according to claim 1, wherein the polymer is a copolymer containing vinyl alcohol units obtainable by hydrolysis of a corresponding vinyl acetate copolymer.

16. An electroviscous fluid according to claim 1, wherein the alkyl group is in the form of comonomer corresponding to formula (II)

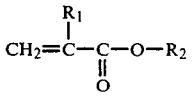

wherein $R_1$=H or $CH_3$ and $R_2$=an aliphatic carbon compound having 4 to 24 carbon atoms.

17. An electroviscous fluid according to claim 1, wherein the weight % of the $C_4$ to $C_{24}$-alkyl is 45 to 78% by weight.

18. An electroviscous fluid according to claim 1, which further comprises up to 35% by weight of a vinyl or vinylidene compound.

19. An electroviscous fluid according to claim 18, wherein the vinyl or vinylidene compound is selected from the group consisting of $C_1$–$C_3$-alkylacrylate, $C_1$–$C_3$-alkylmethacrylate, vinyl acetate, vinyl propionate, styrene, alpha-methylstyrene, butadiene, vinyl chloride and vinylidene chloride.

20. An electroviscous fluid according to claim 1, wherein the non-conductive oily phase dispersion medium is a liquid hydrocarbon selected from the group consisting of paraffins, olefins and aromatics.

* * * * *

UNITED STATES PATENT AND TRADEMARK OFFICE

CERTIFICATE OF CORRECTION

PATENT NO. : 4,668,417

DATED : May 26, 1987

INVENTOR(S) : John Goossens, et al.

It is certified that error appears in the above-identified patent and that said Letters Patent is hereby corrected as shown below:

| | |
|---|---|
| Col. 4, line 16 | Before "20%" delete "about" |
| Col. 4, line 37 | Delete "use" and substitute --range-- |
| Col. 8, Table 1 continued, line 1 under 4th column heading | Delete "815"and substitute --801-- |
| Col. 8, Table 1 continued, line 1 under 5th column heading | Delete "427" and substitute --322-- |

Signed and Sealed this

First Day of March, 1988

*Attest:*

DONALD J. QUIGG

*Attesting Officer*

*Commissioner of Patents and Trademarks*